US008281751B2

(12) United States Patent
Takayama

(10) Patent No.: US 8,281,751 B2
(45) Date of Patent: Oct. 9, 2012

(54) HOT WATER APPARATUS

(75) Inventor: Masayoshi Takayama, Nagoya (JP)

(73) Assignee: Rinnai Corporation, Nagoya-shi (JP)

( * ) Notice: Subject to any disclaimer, the term of this patent is extended or adjusted under 35 U.S.C. 154(b) by 779 days.

(21) Appl. No.: 12/325,491

(22) Filed: Dec. 1, 2008

(65) Prior Publication Data

US 2009/0139466 A1 Jun. 4, 2009

(30) Foreign Application Priority Data

Nov. 29, 2007 (JP) ..... 2007-308211

(51) Int. Cl.
*F24H 9/20* (2006.01)

(52) U.S. Cl. ..... 122/14.2

(58) Field of Classification Search ..... 122/14.2
See application file for complete search history.

(56) References Cited

FOREIGN PATENT DOCUMENTS

| | | |
|---|---|---|
| CN | 1854615 | 11/2006 |
| JP | 02-077912 | 3/1990 |
| JP | 05-018605 | 1/1993 |
| JP | 10-339505 | * 12/1998 |
| JP | 2005-147539 | * 9/2005 |

* cited by examiner

*Primary Examiner* — Gregory A Wilson
(74) *Attorney, Agent, or Firm* — Rankin, Hill & Clark LLP

(57) ABSTRACT

A hot water apparatus comprises a main body thereof connected to each of water distribution devices 31, 32, and 33 via plumbing 2 and a remote controller 20 for remotely controlling the main body of the hot water apparatus 10. The main body of the hot water apparatus 10 comprises a control device 13 capable of controlling temperature of outflowing hot water which is a temperature of the hot water outflowing from the main body of the hot water apparatus 10 to the plumbing 2. The remote controller 20 comprises a setting element of the temperature of the outflowing hot water 21 for setting the requested value of the temperature of the outflowing hot water, and the correction-data setting element 21U and 24 for setting correction data which defines the deviation value of the temperature of the outflowing hot water with respect to the required value. The control device 13 comprises means for performing the processing for correcting the temperature of the outflowing hot water which controls the temperature of the outflowing hot water to the target temperature which is obtained by changing the requested value by the deviation value defined by the set correction data. Therefore, the hot water having the temperature desired by the user can be outflown from the water distribution device and the user-friendly hot water apparatus can be provided.

20 Claims, 4 Drawing Sheets

FIG.4

| REQUESTED VALUE | | 37 | 38 | 39 | 40 | 41 | 42 | 43 | 44 | 45 | 46 | 48 | 50 |
|---|---|---|---|---|---|---|---|---|---|---|---|---|---|
| DEVIATION LEVEL | +1 | 37.0 | 38.1 | 39.2 | 40.3 | 41.4 | 42.5 | 43.6 | 44.7 | 45.8 | 46.9 | 49.0 | 51.0 |
| | +2 | 37.0 | 38.2 | 39.4 | 40.6 | 41.8 | 43.0 | 44.2 | 45.4 | 46.6 | 47.8 | 50.0 | 52.0 |
| | +3 | 37.0 | 38.3 | 39.6 | 40.9 | 42.2 | 43.5 | 44.8 | 46.1 | 47.4 | 48.7 | 51.0 | 53.0 |
| | +4 | 37.0 | 38.4 | 39.8 | 41.2 | 42.6 | 44.0 | 45.4 | 46.8 | 48.2 | 49.6 | 52.0 | 54.0 |
| | +5 | 37.0 | 38.5 | 40.0 | 41.5 | 43.0 | 44.5 | 46.0 | 47.5 | 49.0 | 50.5 | 53.0 | 55.0 |
| | | TARGET TEMPERATURE (REQUESTED VALUE + DEVIATION VALUE) | | | | | | | | | | | |

HOT WATER APPARATUS

BACKGROUND OF THE INVENTION

1. Field of the Invention

The present invention relates to a hot water apparatus.

2. Description of the Related Art

For example, Japanese Patent Laid-open No. 10-339505 discloses a conventional hot water apparatus. The hot water apparatus comprises a main body thereof connected to a water distribution device such as a faucet via plumbing and a remote controller for remotely controlling the main body of the hot water apparatus. The main body of the hot water apparatus is provided with a control device capable of controlling temperature of hot water outflowing from the main body of the hot water apparatus (temperature of the hot water outflowing from the main body of the hot water apparatus to the plumbing). The remote controller is provided with a setting element of temperature of outflowing hot water for setting temperature of outflowing hot water desired by a user (hereinafter referred to as a "requested value") and a display element of temperature of outflowing hot water for displaying the set requested value. Further, the control device is provided with a deviation-value setting element for setting a deviation value (a difference between the temperature of the outflowing hot water targeted by the control device in control processing and the requested value displayed on the display element of the temperature of the outflowing hot water, for example 0.5° C. or 1° C.,) with respect to the requested value. When the deviation-value setting element is operated to set the deviation value described above, the control device has a function for setting the temperature of the hot water outflowing from the main body of the hot water apparatus to target temperature which is obtained by increasing the requested value by the set deviation value and performing processing for correcting the temperature of the outflowing hot water so that the temperature of the hot water outflowing from the main body of the hot water apparatus can be controlled to the target temperature.

In this hot water apparatus, the temperature of the outflowing hot water controlled by the control device is not the temperature of the hot water outflowing from the water distribution device but the temperature of the hot water outflowing from the main body of the hot water apparatus to the plumbing. Therefore, when an amount of heat dissipation is comparatively large on a way of the plumbing from the main body of the hot water apparatus to the water distribution device, and if the temperature of the outflowing hot water is controlled while taking the required value as the target temperature of the hot water outflowing from the main body of the hot water apparatus, the temperature of the hot water outflowing from the water distribution device may be decreased to lower temperature than the requested value due to the heat dissipation on the way of the plumbing. In this case, the user often feels that the temperature of the hot water outflowing from the water distribution device is much lower than the set requested value.

Accordingly, in the hot water apparatus according to Japanese Patent Laid-open No. 10-339505, a predicted decrease of the temperature of the hot water on the way of the plumbing can be set as the deviation value in the deviation-value setting element of the control device in the case described above. This hot water apparatus is adapted to enable the control device to perform the process for correcting the temperature of the outflowing hot water based on the set deviation value so that the temperature of the hot water outflowing from the water distribution device can be substantially equal to the requested value displayed on the display element of the temperature of the outflowing hot water in the remote controller.

However, according to the conventional hot water apparatus described above, the deviation setting element for setting the deviation value is provided in the control device installed in the main body of the hot water apparatus. Therefore, it is difficult in general for the user of the hot water apparatus to operate the deviation setting element to set the deviation value, and only skilled workers in installing the hot water apparatus can set the deviation value when the hot water apparatus is installed.

On the other hand, it is desired that the deviation value is repeatedly changed as needed, since the heat dissipation on the way of the plumbing between the main body of the hot water apparatus and the water distribution device changes depending on the season and the like. Since it is difficult to ask a skilled worker to change the deviation value every time as needed, the temperature of the hot water outflowing from the water distribution device cannot be substantially equal to the requested value desired by the user in many occasions.

The main body of the hot water apparatus including the control device having the deviation setting element is generally disposed at an outside away from a kitchen, lavatory or bath room in which the water distribution device is installed. Therefore, it is necessary for the user to come and go many times between the installation places of the main body of the hot water apparatus and the water distribution device while confirming the temperature of the hot water actually outflowing from the water distribution device until the appropriate deviation value is set. In this case, a work of setting the deviation value is troublesome and annoying.

SUMMARY OF THE INVENTION

The object of the present invention in view of the background described above is to provide a user-friendly hot water apparatus capable of outflowing the hot water having temperature desired by a user from a water distribution device. More specifically, the object is to provide a hot water apparatus which enables the user to easily operate the setting work of the deviation value for outflowing the hot water having the temperature desired by the user from the water distribution device.

In order to achieve an object described above, the hot water apparatus according to the present invention comprises a main body thereof connected to a water distribution device via plumbing and a remote controller for remotely controlling the main body of the hot water apparatus. The main body of the hot water apparatus comprises a control device capable of controlling temperature of outflowing hot water which is a temperature of the hot water outflowing from the main body of the hot water apparatus to the plumbing, and the remote controller comprises a setting element of the temperature of the outflowing hot water for setting a requested value of the temperature of the outflowing hot water and a correction-data setting element for setting correction data which defines a deviation value of the temperature of the outflowing hot water with respect to the requested value, wherein, when the correction data is set by an operation of the correction-data setting element, the control device has means for performing processing for correcting the temperature of the outflowing hot water so that the temperature of the outflowing hot water is controlled to the target temperature which is obtained by changing the requested value by the deviation value defined by the correction data (first invention).

In the hot water apparatus of the first invention, when the setting element of the temperature of the outflowing hot water in the remote controller is operated, the arbitrary requested value of the temperature of the hot water outflowing from the main body of the hot water apparatus is set in the control device of the main body of the hot water apparatus. The requested value is the temperature of the hot water outflowing from the main body of the hot water apparatus to the plumbing, that is, a requested value of the temperature of the outflowing hot water at an outlet of the main body of the hot water apparatus. In many cases, the user sets the requested value of the temperature of the hot water actually outflowing from the water distribution device (the temperature desired by a user) as the requested value of the temperature of the hot water outflowing from the main body of the hot water apparatus.

As described above, temperature of the hot water actually outflowing from the water distribution device may be decreased to lower temperature than the set requested value due to the heat dissipation on the way of the plumbing. When this problem is concerned, the user sets correction data for defining the deviation value for the control device by a correction-data setting element in the remote controller. The correction data, basically, may be set such that the deviation value defined as described above is equivalent to temperature of the hot water to be decreased on the way of the plumbing. The "correction data" according to the present invention may be the value of the deviation itself, or something representing a level of a size of the deviation value (for example, such as an integer of "0" or more and an alphabet), as described below.

The correction data is set as describe above, and the control device performs the processing for correcting the temperature of the outflowing hot water. In the processing for correcting the temperature of the outflowing hot water, temperature changed from the requested value by the deviation value defined by the set correction data is used as the target temperature of the temperature of the hot water outflowing from the main body of the hot water apparatus. The temperature of the outflowing hot water is controlled to the target temperature. With this control, the temperature of the hot water actually outflowing from the water distribution device can be set substantially equal to the requested value.

Further, in the hot water apparatus of the first invention, the correction-data setting element for setting the correction data is provided in the remote controller which is often provided at a place near the water distribution device. Accordingly, in many cases, the user can set the correction data and consequently enable the control device to perform the processing for correcting the temperature of the outflowing hot water at a place near the water distribution device. The user, therefore, can set the correction data as confirming the temperature of the hot water outflowing from the water distribution device and accordingly easily set the appropriate correction data such that the temperature of the hot water actually outflowing from the water distribution device can be equal to the requested value. As a result, the user-friendly hot water apparatus can be provided.

According to the first invention described above, it is preferable that the remote controller is provided with the display element for displaying the requested value without displaying the target temperature while the control device performs the processing for correcting the outflowing hot water (second invention).

That is, when the set requested value is displayed on the display element in the remote controller, the user can grasp how hot the set requested value is by one's sense from one's own experience. Note that the user normally considers the displayed requested value as the temperature equivalent to temperature of the hot water actually outflowing from the water distribution device. If the target temperature changed from the requested value by the deviation value defined by the set correction data considering the heat dissipation on the way of the plumbing, that is, the actual target value of the temperature of the hot water outflowing from the main body of the hot water apparatus is displayed on the display element of the remote controller, the user looking at the display may misunderstand that the target temperature is equivalent to the temperature of the hot water actually outflowing from the water distribution device, resulting in recognizing that the temperature is too hot.

In the second invention, therefore, the display element displays the requested value without displaying the target temperature while the control device performs the processing for correcting the temperature of the outflowing hot water. With this arrangement, the temperature (requested value) displayed on the display element in the remote controller can be adjusted (substantially equal) to the temperature of the hot water actually outflowing from the water distribution device. In other words, the hot water having the temperature (substantially equal to the temperature displayed on the display element in the remote controller) which matches a temperature sense of the user obtained from the experience can be flown from the water distribution device.

In the second invention, it is preferable that the display element has a function for displaying at least one of the value of the correction data, the deviation value defined by the correction data and the target temperature obtained by changing the requested value by the deviation value while the correction-data setting element is operated to set the correction data (third invention).

According to the third invention, since the display element in the remote controller displays at least one of the deviation value defined by the value of the correction data and the correction data and the target temperature obtained by changing the requested value by the deviation value while the correction-data setting element is operated to set the correction data, the user can operate the correction-data setting element in the remote controller to set the correction data while confirming the value of the correction data or the deviation value or the target temperature.

In the first to third inventions described above, when the requested value is a predetermined temperature previously defined or lower, it is preferable that the control device has means for controlling the temperature of the outflowing hot water to the target temperature which is the requested value without depending on the correction data (fourth invention).

That is, when the requested value is the predetermined temperature previously defined or lower, temperature to be decreased due to the heat dissipation on the way of the plumbing is generally small enough. Accordingly, in this case, the control device controls the temperature of the outflowing hot water to the target temperature which is the requested value in order to prevent water in the main body of the hot water apparatus from unnecessarily being heated up, resulting in decreasing waste of energy consumption.

In the first to fourth inventions, it is possible to use data representing, for example, a level of a size of the deviation value as the correction data. In this case, it is preferable that the control device or the remote controller is provided with means for determining the deviation value according to the correction data and the requested value. It is preferable that the means for determining the deviation value determines the deviation value so that the deviation value becomes larger along with the increasing level of the size of the deviation value represented by the correction data and the deviation value becomes larger along with the increasing requested value (fifth invention).

That is, the higher the temperature of the hot water outflowing from the main body of the hot water apparatus to the plumbing is, the higher the degree of the heat dissipation from the plumbing becomes. In the fifth invention, therefore, the larger the degree of the size of the deviation value represented by the correction data is, the larger the deviation value is determined. Additionally, the higher the requested value is, the larger the deviation value is determined. With this determination, it is possible to determine the deviation value according to the requested value of the temperature of the outflowing hot water and suitable for the degree of the heat dissipation, resulting in enabling the control device to perform the rational process for correcting the temperature of outflowing hot water according to the requested value.

In the fifth invention, the means for determining the deviation value may be of course the means for directly determining the deviation value itself, and also the means for determining the value obtained by changing the requested value by the deviation value, that is, the target temperature. This is because the deviation value can be also indirectly determined by determining the target temperature.

Further, in the first to fifth inventions, it is preferable, when a plurality of the remote controllers are provided, that each remote controller is provided with a priority setting element enabling the deviation value to be changed in priority to other remote controllers (sixth invention).

According to the sixth invention, the priority setting element in the remote controller provided near the water distribution device actually used is operated so as to avoid the correction data from being changed or set by other remote controllers while the water distribution device is used and avoid the control device from performing the processing for correcting the temperature of the outflowing hot water based on the correction data. Thus, operations of the remote controllers can be avoided from getting confused when the processing for the temperature of the outflowing hot water is performed.

BRIEF DESCRIPTION OF THE DRAWINGS

FIG. 4 is a table illustrating relationships among the requested value and a deviation level of temperature of outflowing hot water and a target temperature in the hot water apparatus according to other exemplary embodiment.

DETAILED DESCRIPTION OF THE PREFERRED EMBODIMENTS

<Exemplary Embodiment 1>

Figure 1:
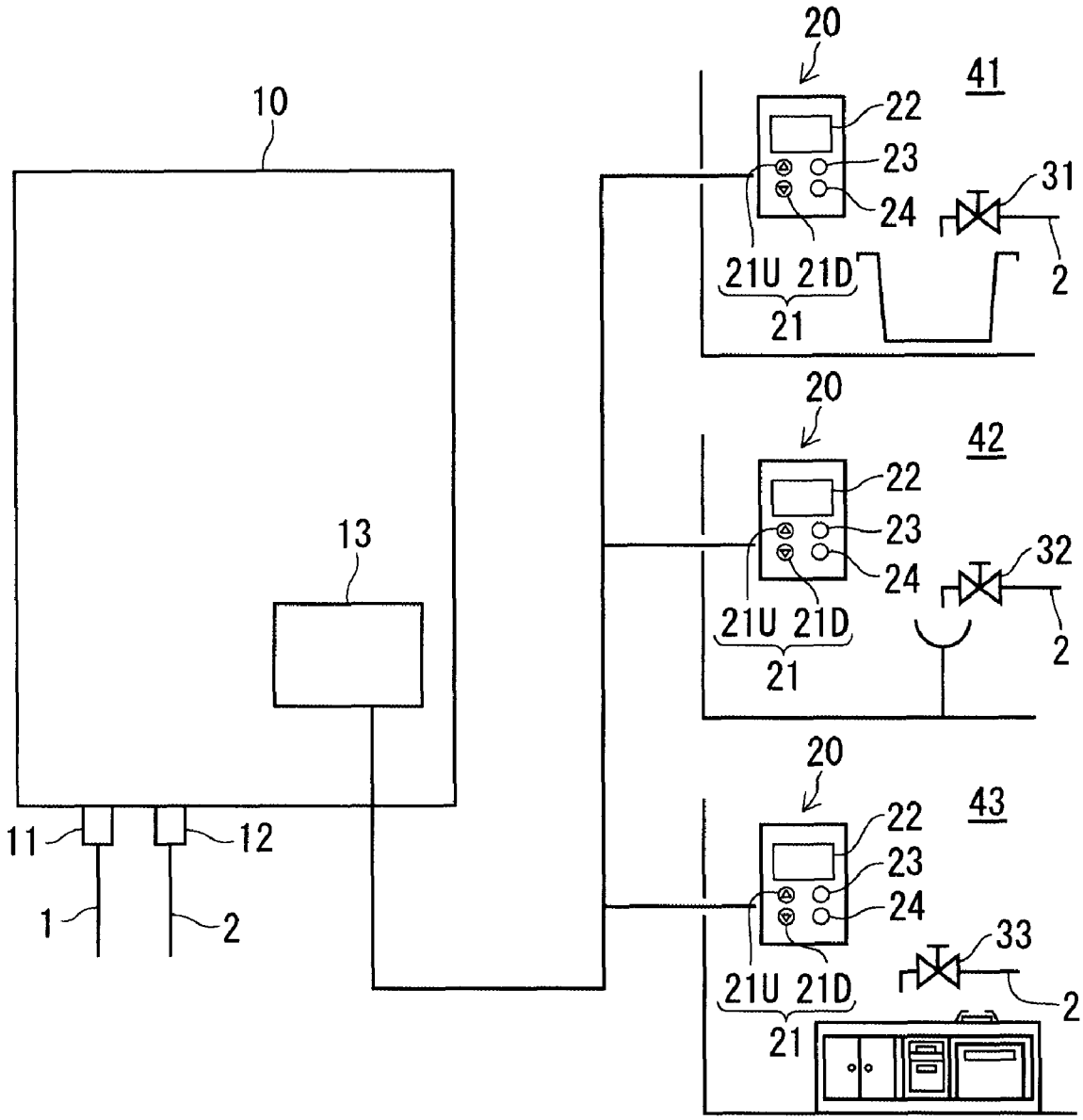
FIG. 1 is a schematic view illustrating a hot water apparatus according to one exemplary embodiment (Exemplary Embodiment 1) of the present invention.

With reference to the FIGS. 1 to 3, Exemplary Embodiment 1 of the present invention will be described. The hot water apparatus of the present exemplary embodiment, as illustrated in FIG. 1, comprises a main body of a hot water apparatus 10 and a remote controller 20 for remotely controlling the main body of the hot water apparatus 10. A water inlet 11 and a water outlet 12 are provided on a lower surface of the main body of the hot water apparatus 10. A water pipe 1 is connected to the water inlet 11, and plumbing 2 connecting to each of water distribution devices 31, 32 and 33 is connected to the water outlet 12. The hot water apparatus of the present exemplary embodiment comprises a plurality (for example, three) remote controllers 20, 20 and 20, each remote controller 20 being provided on each wall surface of a bathroom 41, lavatory 42, and a kitchen 43. The water distribution devices 31, 32, and 33 are respectively provided at the bathroom 41, lavatory 42 and the kitchen 43.

A combustion system (not illustrated) for heating up water flowing through the water inlet 11 into the main body of the hot water apparatus 10 via a heat exchanger is built in the main body of the hot water apparatus 10. Further, in the main body of the hot water apparatus 10, there is provided a control device 13 capable of controlling the temperature of the outflowing hot water which is the temperature at the water outlet 12 of the main body of the hot water apparatus 10, that is, the temperature of the hot water outflowing from the main body of the hot water apparatus 10 to the plumbing 2 (hereinafter, referred to as the "temperature of the hot water outflowing from the main body of the hot water apparatus 10", or simply the "temperature of the outflowing hot water"). The control device 13 comprises an electronic circuit unit including CPU, RAM and ROM that are not illustrated. As control processing realized by a program which has been previously installed, the control device 13 includes processing "a setting mode of the temperature of the outflowing hot water" capable of variably setting the requested value of the temperature of the outflowing hot water, and "a deviation-value setting mode" capable of variably setting the deviation value (an amount of increased temperature of the outflowing hot water with respect to the requested value) with respect to the requested value. The control device 13 preferentially selects and performs "the setting mode of the temperature of the outflowing hot water". The control device 13 performs "the deviation-value setting mode" only when a specific operation is performed on the remote controller 20.

Further, in a case where the deviation value (deviation value not "0") is set in "the deviation-value setting mode" as described below, when any one of the water distribution devices 31, 32, and 33 is used for outflowing the hot water, the control device 13 has a function for performing the processing for correcting the temperature of the outflowing hot water based on the deviation value. The processing for correcting the temperature of the outflowing hot water is the processing (for more detail, processing for controlling an amount of combustion of the combustion system) for controlling an operation of the main body of the hot water apparatus 10 so that the actual temperature of the outflowing hot water becomes the target temperature targeted as the temperature of the hot water outflowing from the main body of the hot water apparatus 10 which is obtained by adding the deviation value set in "the deviation-value setting mode" to the requested value set in "the mode of the temperature of the outflowing hot water". In a case where the deviation value is not set (when deviation value=0), when any one of the water distribution devices 31, 32, and 33 is used for the outflowing hot water, the control device 13 has a function for performing processing (hereinafter, referred to as basic processing for controlling the outflowing hot water) for controlling the operation of the main body of the hot water apparatus 10 so that the actual temperature of the outflowing hot water becomes the target temperature by using the requested value as the target temperature of the outflowing hot water.

A remote controller 20 comprises a setting element of the temperature of the outflowing hot water 21 including an Up switch 21U and a Down switch 21D for mainly setting the requested value of the temperature of the outflowing hot water, a display element 22 for displaying the requested value of the temperature of the outflowing hot water, a priority switch 23 as a priority setting element for specifying the remote controller 20 having a priority for setting the requested value of the temperature of the outflowing hot water, and an On-Off switch 24 for starting or stopping the hot water apparatus. Further, the remote controller 20 comprises control and communication circuits therein (not illustrated), of which operations enable data such as operation signals of the switches 21U, 21D, 23, and 24 to be received and transmitted between the remote controller 20 and the control device 13, and the display contents to be controlled on the display element 22.

Additionally, according to the present exemplary embodiment, the Up switch 21U, the Down switch 21D and the priority switch 23 in each remote controller 20 also have a function for proceeding the processing of the control device 13 from "the setting mode of the temperature of the outflowing hot water" to "the deviation-value setting mode". The Up switch 21U and the On-Off switch 24 also have a function as a correction-data setting element according to the present invention in "the deviation-value setting mode". The Up switch 21U has both functions of the setting element of the temperature of the outflowing hot water 21 and the correction-data setting element.

Next, an operation of the hot water apparatus of the present exemplary embodiment in accordance with the operation of the remote controller 20 will be described.

First, when the user performs an On operation (pressing) of the On-Off switch 24 in any of the remote controllers 20 to drive the hot water apparatus, the current requested value of the temperature of the outflowing hot water is displayed on the display element 22 in the remote controller 20. Note that the requested value to be displayed is a value given from the control device 13 according to the On operation of the On-Off switch 24, or a value stored in a memory (not illustrated) by each remote controller 20.

Further, in the main body of the hot water apparatus 10, control processing in "the setting mode of the temperature of the outflowing hot water" is started in the control device 13 and an electromagnetic valve of the combustion system (not illustrated) built in the main body of the hot water apparatus 10 is in a state of ready (ready for combustion driving control of the combustion system) under control of the control device 13. With this arrangement, the hot water apparatus is ready for starting up to outflow the hot water from any one the water distribution devices 31, 32 and 33.

In this state, when the user opens a valve of any one of the water distribution devices 31, 32, and 33 to start to outflow the water into the plumbing 2, the control device 13 controls to start the combustion driving of the combustion system in the main body of the hot water apparatus 10. And, the water heated by the combustion driving in the main body of the hot water apparatus 10 outflows from any one of the opened water distribution devices 31, 32, and 33.

In the control device 13 as described above, in the state where the control processing of "the setting mode of the temperature of the outflowing hot water" is started up, the user presses either one of the Up switch 21U and the Down switch 21D in the setting element of the temperature of the outflowing hot water 21 in the remote controller 20 so that the requested value of the temperature of the outflowing hot water can be changed to the value desired by the user. According to the present exemplary embodiment, the requested value has an upper limited value of 50° C. and can be changed for every 1° C. That is, every time the user presses once the Up switch 21U in the setting element of the temperature of the outflowing hot water 21 in the remote controller 20, the requested value is increased by 1° C., and every time the user presses once the Down switch 21D, the requested value is decreased by 1° C. The requested value renewed as described above is displayed on the display element 22 every time renewed. Therefore, the user presses the Up switch 21U or the Down switch 21D to set the requested value while confirming the requested value displayed on the display element 22. The requested value set as described above is input from the remote controller 20 to the control device 13. In a case where the deviation value is not set, when any one of the water distribution devices 31, 32, and 33 outflows the hot water, the control device 13 performs the basic processing for controlling the outflowing hot water. Accordingly, the temperature of the hot water outflowing from the main body of the hot water apparatus 10 is controlled targeting the requested value (the current requested value) displayed on the display element 22 as the target temperature.

If the user press the priority switch 23 in any one of the remote controllers 20 prior to setting the requested value described above, the requested value can be variably set by only the remote controller 20 whose priority switch 23 is pressed. In this state, the requested value cannot be variably set by other remote controllers 20. That is, even if the Up switch 21U or the Down switch 21D in the other remote controllers 20 is pressed, the requested value of the temperature of the outflowing hot water is not changed. Therefore, the remote controller 20 which can variably change the requested value is limited to the remote controller 20 whose priority switch 23 is pressed.

After completing to set the requested value of the temperature of the outflowing hot water, when the user performs an Off operation (pressing again) of the On-Off switch, the hot water apparatus becomes in a state of stopping driving, and the display of the requested value of the temperature of the outflowing hot water on the display element 22 is turned off. In this state, the requested value cannot be variably set. Further, in this state, even if any one of the water distribution devices 31, 32, and 33 is opened, the combustion driving of the combustion system in the hot water apparatus is not performed, and the water flowing into the main body of the hot water apparatus 10 outflows from any one of the opened water distribution devices 31, 32, and 33 without being heated up.

On the other hand, due to the heat dissipation in the plumbing 2, when the hot water is outflown from any one of the water distribution devices 31, 32, and 33, the user may feel that the temperature of the hot water actually outflowing from any one of the water distribution devices 31, 32, and 33 is too low with respect to the requested value displayed on the display element 22. In this case, the user variably sets the deviation value to enable the control device 13 to perform the processing for correcting the temperature of the outflowing hot water based on the deviation value. In this case, the control device 13 starts up the control processing of "the deviation-value setting mode".

More specifically, when the requested value of the temperature of the outflowing hot water is not displayed (state of stopping driving of the hot water apparatus) on the display element 22 in each remote controller 20, the user press simultaneously the Up switch 21U, the Down switch 21D and the priority switch 23 in any one of the remote controllers 20 to start up the control processing of "the deviation-value setting mode" in the control device 13. Pressing simultaneously a plurality of switches (according to the present invention, the Up switch 21U, Down switch 21D, and the priority switch 23) in the remote controller 20 by the user, which is not performed in a normal operation, can prevent the deviation value from being changed unconsciously.

Figure 2:
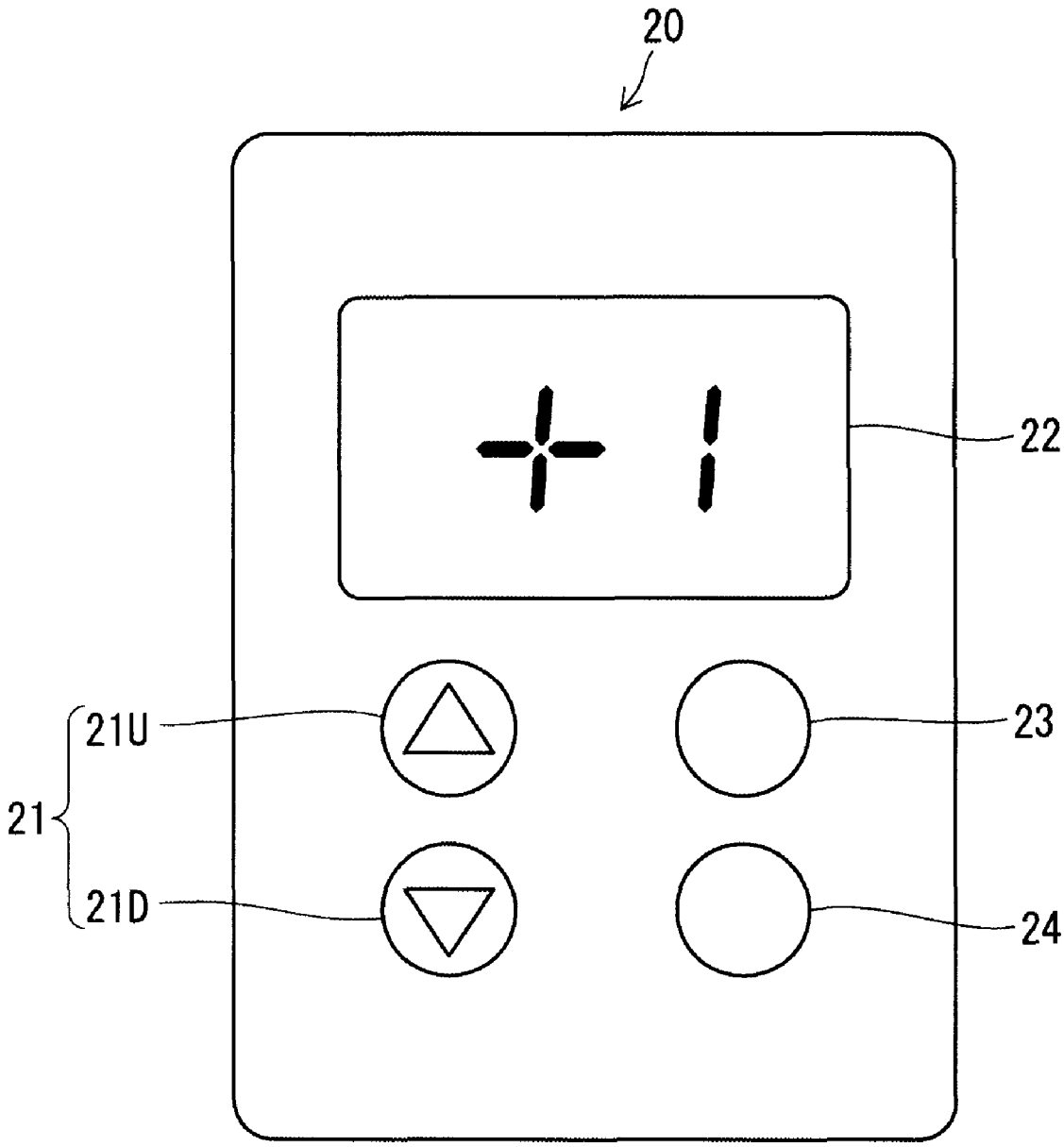
FIG. 2 is a front view illustrating a remote controller of the hot water apparatus according to Exemplary Embodiment 1 in "a deviation setting mode"

As described above, when the control processing of "the deviation-value setting mode" is started up in the control device 13, a value of the deviation level representing a level of a size of a current deviation value is displayed on the display element 22 in the remote controller 20 as illustrated in FIG. 2. According to) the present exemplary embodiment, the deviation level is equivalent to the correction data of the present invention. Note that the value of the deviation level to be displayed is a value given from the control device 13, or a value stored in a memory (not illustrated) by each remote controller 20.

In "the deviation-value setting mode", the function of the Up switch 21U and the On-Off switch 24 in the remote controller 20 is the correction-data setting element which is changed from that in "the setting mode of the temperature of the outflowing hot water". That is, when variably setting the deviation value, the user presses the Up switch 21U in the remote controller 20 to change the value of the deviation level. After changing the value, the user presses the On-Off switch 24 to set the value of the deviation level for the control device 13, and the mode of the control processing of the control device 13 proceeds to "the setting mode of the temperature of the outflowing hot water".

Figure 3:
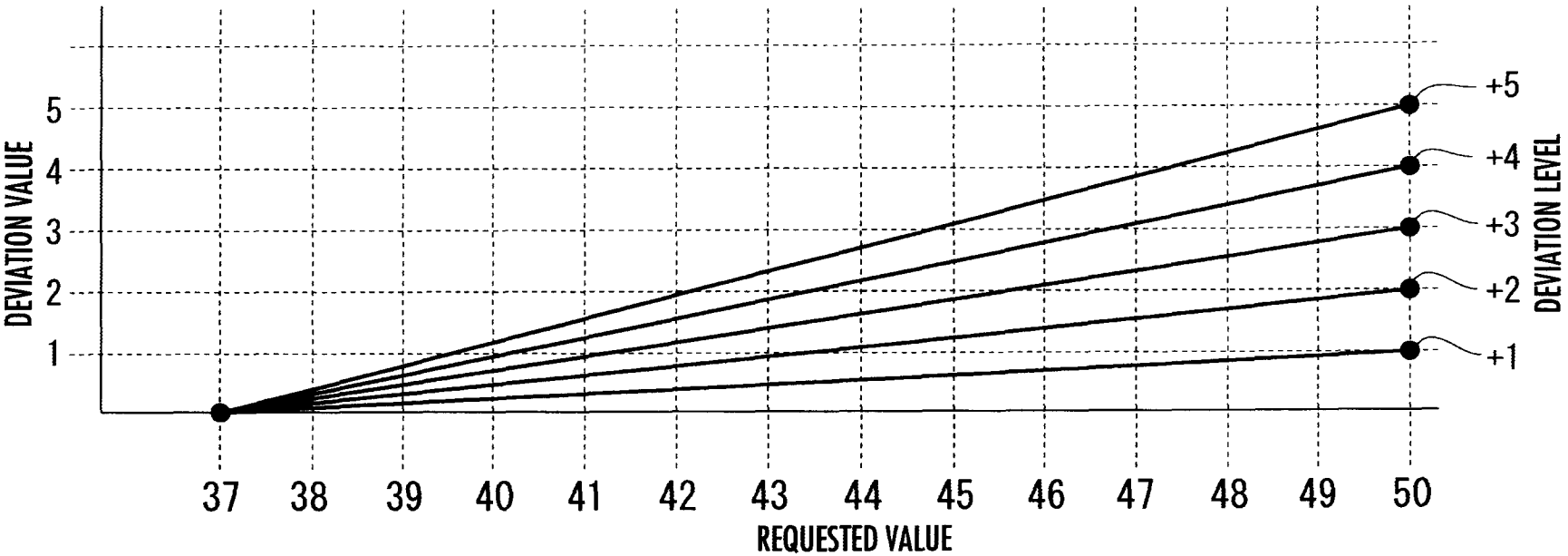
FIG. 3 is a graph illustrating relationships among a requested value, a deviation level and a deviation value of temperature of outflowing hot water in the hot water apparatus according to Exemplary Embodiment 1.

Now, the value of the deviation level according to the present exemplary embodiment can be set to six types of integers from 0 to +5 as illustrated in FIG. 3. The larger the value of the deviation level is, the larger the deviation value set according to the value of the deviation level becomes. The value of the deviation level equal to "0" means that the deviation value is set to "0", in other words, the control device 13 performs the basic processing for controlling the outflowing hot water which uses the set requested value as the target temperature of the hot water outflowing from the main body of the hot water apparatus 10 without performing the processing for correcting the temperature of the outflowing hot water based on the deviation value.

In "the deviation-value setting mode", the value of the deviation level is increased by 1 every time the Up switch 21U is pressed once. Note that, according to the present exemplary embodiment, in a state where the value of the deviation level is set to "+5", when the user presses the Up switch 21U, the value of the deviation level is reset to "0". The value of the deviation level set as described above is displayed on the display element 22 in the remote controller 20. Therefore, the user can set the desired value of the deviation level for the control device 13 while confirming the value of the deviation level displayed on the display element 22. When the user presses the On-Off switch 24 (setting the deviation level is completed and control processing in the control device 13 proceeds to "the setting mode of the temperature of the outflowing hot water") after the value of the deviation level is renewed, the display of the value of the deviation level on the display element 22 ends, and the current requested value of the temperature of the outflowing hot water is displayed on the display element 22.

The control device 13 determines the deviation value to be actually used for the processing for correcting the temperature of the outflowing hot water from the value of the deviation level set as described above and the currently set requested value of the temperature of the outflowing hot water. According to the present exemplary embodiment, the control device 13 previously stores correlation data representing the relationships among the value of the deviation level, the requested value, and the deviation value in a form of a map or an operational expression. And the control device 13 determines the deviation value from the given value of the deviation level and the currently-set requested value of the temperature of the outflowing hot water based on the above-described correlation data. In this case, the relationships among the value of the deviation level, the requested value, and the deviation value represented by the correlation data are, for example, the relationships as illustrated in FIG. 3. When the requested value of the temperature of the outflowing hot water is 37° C. or lower, the deviation value determined based on the correlation data is determined as "0" regardless of the value of the deviation level and the requested value. When the requested value is 38° C. or higher (when the requested value is between 38 to 50° C.), the larger the value of the deviation level is, or the higher the requested value is, the larger the deviation value is determined. In this case, according to the present exemplary embodiment, when the value of the deviation level is set constant, the deviation value is proportional to a difference(=the requested value−37° C.) between the requested value of the temperature of the outflowing hot water and 37° C. Additionally, when the requested value is set constant, the deviation value is determined to be proportional to the value of the deviation level. Note that the deviation value is always set to "0" when the value of the deviation level is "0".

According to the present exemplary embodiment as described above, when the requested value is 38° C. or higher, the deviation value is determined to depend on the requested value as well as the value of the deviation level. This is because, the higher the requested value of the temperature of the outflowing hot water is and eventually the higher the actual temperature of the hot water outflowing from the main body of the hot water apparatus 10 is, the more the heat is discharged in the plumbing 2. And, the temperature of the hot water is further decreased due to the heat dissipation. As described above, considering the degree of the heat dissipation in the plumbing 2, the deviation value is determined depending on the requested value of the temperature of the outflowing hot water as well as the value of the deviation level. Thus, even when the user can only assume the degree of the heat dissipation in the plumbing 2 roughly, the deviation value having substantially equal value of temperature of the hot water to be decreased in the plumbing 2 can be determined.

Further, when the temperature of the hot water outflowing from the main body of the hot water apparatus 10 is 37° C. or lower, the temperature to be decreased due to the heat dissipation on the way of the plumbing 2 is small enough. According to the present exemplary embodiment, therefore, when the requested value of the temperature of the outflowing hot water is 37° C. or lower, the deviation value is determined as "0" to prevent the hot water in the main body of the hot water apparatus 10 from unnecessarily being heated up, resulting in decreasing waste of energy consumption in the main body of the hot water apparatus 10.

Further, according to the present exemplary embodiment, the upper limit of the deviation value is set to 5° C. That is, in general, it is hard to think that the temperature of the hot water outflowing from any one of the water distribution devices 31, 32, and 33 is decreased from the requested value by 5° C. due to the heat discharge in the plumbing 2. Further, if a too large deviation value is allowed, the temperature of the hot water outflowing from any one of the water distribution devices 31, 32, and 33 can have a large difference from the requested value displayed on the display element 22 in the remote controller 20. Therefore, according to the present exemplary embodiment, the upper limit of the deviation value is defined as 5° C.

In "the deviation-value setting mode", the priority switch 23 in the remote controller 20 functions as the priority setting element as well as in "the setting mode of the temperature of the outflowing hot water". That is, in "the deviation-value setting mode", only the remote controller 20 whose priority switch 23 is pressed by the user can variably set the deviation value and other remote controllers 20 cannot variably set the deviation value (even other remote controller 20 is operated for variably setting the deviation value, the deviation value does not change). Therefore, after starting up the control processing in "the deviation-value setting mode" by the remote controller 20 installed near any one of the water distribution devices 31, 32, and 33 actually used by the user, when the user presses the priority switch 23 in the remote controller 20, other remote controllers 20 cannot change the setting of the deviation value. Thus, the mixed up operations of the remote controllers 20 can be avoided.

After setting the deviation level as described above, when the user opens the valve of any one of the water distribution devices 31, 32, and 33 to start to flow the water through the plumbing 2, the control device 13 performs the process for correcting the temperature of the outflowing hot water (here, the set deviation level is not to be "0"). While the processing for correcting the temperature of the outflowing hot water is performed, the display element 22 in the remote controller 20 displays the set requested value as it is. In this case, the target temperature used in the processing for correcting the temperature of the outflowing hot water by the control device 13 is the temperature obtained by adding the set deviation value to the requested value displayed on the display element 22. That is, the target value is the temperature obtained by adding the temperature of the hot water to be decreased in the plumbing 2 to the requested value. Therefore, the temperature of the hot water actually outflowing from opened one of the water distribution devices 31, 32, and 33, is substantially equal to the requested value displayed on the display element 22. Accordingly, even the heat is discharged in the plumbing 2, the hot water having the temperature desired by the user can be outflown from any one of the water distribution devices 31, 32, and 33.

As described above, the user operates the remote controller 20 installed in a place where the hot water is used such as the bathroom 41, lavatory 42 and kitchen 43 to set the deviation value and further enables the control device 13 to perform the processing for correcting the temperature of the outflowing hot water based on the deviation value. Therefore, the user can set the appropriate deviation value for the control device 13 while confirming the temperature of the hot water outflowing from any one of the water distribution devices 31, 32, and 33. Accordingly, the user does not have to come and go many times between the main body of the hot water apparatus 10 and any one of the water distribution device 31, 32, and 33 to set the appropriate deviation value, resulting in producing the user-friendly hot water apparatus.

As described above, according to the hot water apparatus of Exemplary Embodiment 1, regardless of the heat dissipation on the way of the plumbing 2, the hot water having the temperature desired by the user can be outflown from any one of the water distribution devices 31, 32, and 33. Further, unlike the conventional hot water apparatus, since the user can set the deviation value by the remote controller 20 without going to a place where the main body of the hot water apparatus 10 is installed, the user can easily set the deviation value at any time.

<Other Exemplary Embodiment>

The present invention is not limited to Exemplary Embodiment 1 described above, for example, following exemplary embodiments are included in a technical field of the present invention. Further, in addition to the followings, various aspects of the present invention can be made without departing from the spirit and scope thereof.

(1) According to Exemplary Embodiment 1, according to the requested value of the temperature of the outflowing hot water and the deviation level, the deviation value may be directly set in an aspect illustrated in FIG. 3. However, assuming a length of the plumbing 2 and environment where the hot water apparatus is installed, the target temperature of the outflowing hot water may be determined from the requested value of the temperature of the outflowing hot water and the deviation level as illustrated in FIG. 4. In this case, since "target temperature=requested value+deviation value" is satisfied, the deviation value is indirectly determined by determining the target value.

(2) According to Exemplary Embodiment 1, the deviation value is set step by step according to the values of the six types of the deviation levels. However, the value of the deviation level, and eventually the deviation value may be continuously set.

(3) According to Exemplary Embodiment 1, when the requested value of the temperature of the outflowing hot water is 37° C. or lower, the deviation value is always set to "0". However, the deviation value other than "0" may be set for the requested value which is 37° C. or lower according to the length of the plumbing 2 and environment where the hot water apparatus is installed.

(4) According to Exemplary Embodiment 1, the deviation level can be changed only by pressing the Up switch 21U in the remote controller 20. However, each pressing of the Up switch 21U and the Down switch 21D may change the deviation level in both directions of increasing and decreasing.

(5) When "the setting mode of the temperature of the outflowing hot water" is selected, or when the hot water is outflowing, the deviation level in addition to the requested value of the temperature of the outflowing hot water may be displayed.

(6) According to Exemplary Embodiment 1, the processing for determining the deviation value from the requested value of the temperature of the outflowing hot water and the deviation level (eventually, processing for determining the target temperature) is performed by the control device 13. However, the processing for determining the deviation value or the target temperature may be performed by the remote controller 20 by which the user sets the deviation level. And the remote controller 20 may give the determined deviation value or the target temperature to the control device 13.

(7) According to Exemplary Embodiment 1, in "the deviation-value setting mode", the deviation level is displayed on the display element 22. However, instead of the deviation level, or together with the deviation level, the deviation value determined according to the deviation level and the requested value of the temperature of the outflowing hot water, or the target temperature may be displayed on the display element 22.

(8) According to Exemplary Embodiment 1, the value of the deviation level representing the level of the size of the deviation value is defined as an integer. However, for example, an alphabet (A, B, C, and the like) may be used to represent the level of the size of the deviation value.

What is claimed is:

1. A hot water apparatus comprising a main body connected to a water distribution device via plumbing, a remote controller for remotely controlling the main body of the hot water apparatus, and a deviation value determining element, the main body of the hot water apparatus comprising a control device configured to control a temperature of outflowing hot water, which is a temperature of the hot water outflowing from the main body of the hot water apparatus to the plumbing;

the remote controller comprising: a setting element configured to set a requested value of the temperature of outflowing hot water; and a correction-data setting element configured to set correction data as a deviation level; and the deviation value determining element is configured to determine a deviation value based on the deviation level and the requested value, wherein, when the correction data is set by an operation of the correction-data setting element and the deviation value is determined by the deviation value determining element, the control device is configured to perform processing for correcting the temperature of the outflowing hot water so that the temperature of the outflowing hot water is controlled to a target temperature which is obtained by changing the requested value by the deviation value, and wherein, when the requested value is less than or equal to a predetermined temperature, the deviation value determining element is configured to determine the deviation value as a predetermined minimum deviation value, and the control device is configured to control the temperature of outflowinq hot water to the target temperature which is obtained by changing the requested value of the temperature of outflowinq hot water by the predetermined minimum deviation value.

2. The hot water apparatus according to claim 1, wherein the remote controller comprises a display element for displaying the requested value without displaying the target temperature while the processing for correcting the temperature of the outflowing hot water is performed by the control device.

3. The hot water apparatus according to claim 2, wherein the display element has a function for displaying at least any one of a value of the correction data, the deviation value defined by the correction data, and the target temperature obtained by changing the requested value by the deviation value while the correction data is set by the correction-data setting element.

4. The hot water apparatus according to claim 1, wherein the deviation value determining element is configured to determine the deviation value based on a predetermined function for each deviation level, the predetermined functions being set such that the deviation value increases as the deviation level and the requested value increase.

5. The hot water apparatus according to claim 4, wherein the deviation level is set as an integer in a range between 0 and a predetermined high-end deviation level, each deviation level being associated with a unique predetermined function, the predetermined functions being mathematical functions, for determining the deviation level using the requested value as a variable in the unique mathematical function.

6. The hot water apparatus according to claim 5, wherein the predetermined functions are linear mathematical functions having a non-zero slope.

7. The hot water apparatus according to claim 1, further comprising a plurality of the remote controller, each remote controller being provided with a priority setting element enabling the deviation value to be changed in priority to other remote controllers.

8. The hot water apparatus according to claim 1, wherein the requested value is selected from a requested value temperature range having a predetermined high-end temperature, the deviation level is set as an integer in a range between 0 and a predetermined high-end deviation level, and the deviation value determining element is configured to determine the deviation value based on a predetermined function for each deviation level, the predetermined functions being set such that the deviation value is the predetermined minimum deviation value when the requested value is less than or equal to the predetermined temperature, and the deviation value is set to equal the deviation level when the requested value is the predetermined high-end temperature.

9. The hot water apparatus according to claim 8, wherein the predetermined minimum deviation value is 0.

10. The hot water apparatus according to claim 8, wherein the predetermined high-end temperature is 50° C., the predetermined high-end deviation level is 5, and the predetermined temperature is 37° C.

11. The hot water apparatus according to claim 8, wherein the predetermined function for each deviation level for a range between the predetermined temperature and the predetermined high-end temperature is a linear mathematical function having a non-zero slope unique to each deviation level, wherein a slope value for the linear mathematical functions increases as the deviation level increases.

12. The hot water apparatus according to claim 1, wherein the deviation value determining element is provided in the control device.

13. The hot water apparatus according to claim 1, wherein the deviation value determining element is provided in the remote controller, and the remote controller is configured to transmit the requested value and the determined deviation value to the control device.

14. The hot water apparatus according to claim 1, wherein the predetermined temperature is 37° C.

15. The hot water apparatus according to claim 14, wherein the predetermined minimum deviation value is zero.

16. The hot water apparatus according to claim 1, wherein the remote controller is configured for a user to input the requested value and deviation level, and the setting element and the correction-data setting element are configured to respectively set the input requested value and deviation level as the requested value and the deviation level.

17. The hot water apparatus according to claim 1, wherein the deviation value determining element is configured to determine the deviation value by referencing a look-up table and selecting a predetermined deviation value corresponding to the set deviation level and requested value as the determined deviation value, the look-up table including predetermined deviation values for each possible pairing of deviation level and requested value.

18. The hot water apparatus according to claim 17, wherein the remote controller is configured to allow the requested value to be set as an integer with an upper limit of 50° C., and the deviation level to be set as an integer in a range between 0 and 5.

19. The hot water apparatus according to claim 17, wherein the deviation value is set to the predetermined minimum deviation value when the requested value is less than the predetermined temperature.

20. A hot water apparatus comprising a main body connected to a water distribution device via plumbing, a remote controller for remotely controlling the main body of the hot water apparatus, and a deviation value determining element, the main body of the hot water apparatus comprising a control device configured to control a temperature of outflowing hot water, which is a temperature of the hot water outflowing from the main body of the hot water apparatus to the plumbing;

the remote controller comprising: a setting element configured to set a requested value of the temperature of outflowing hot water; and a correction-data setting element configured to set correction data as a deviation level; and the deviation value determining element is configured to determine a deviation value based on the deviation level and the requested value, wherein, when the correction data is set by an operation of the correction-data setting element and the deviation value is determined by the deviation value determining element, the control device is configured to perform processing for correcting the temperature of the outflowing hot water so that the temperature of the outflowing hot water is controlled to a target temperature which is obtained by changing the requested value by the deviation value, and wherein the deviation value determining element determines the deviation value so that the deviation value becomes larger along with the increasing level of the size of the deviation value represented by the correction data and the deviation value becomes larger along with the increasing requested value.

* * * * *